US010893368B2

(12) United States Patent
Nikles et al.

(10) Patent No.: US 10,893,368 B2
(45) Date of Patent: Jan. 12, 2021

(54) ANTENNA AND DEVICE WITH SUCH AN ANTENNA

(71) Applicant: SIVANTOS PTE. LTD., Singapore (SG)

(72) Inventors: Peter Nikles, Erlangen (DE); Sebastian Suedekum, Magdeburg (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/435,750

(22) Filed: Jun. 10, 2019

(65) Prior Publication Data

US 2019/0394584 A1 Dec. 26, 2019

(30) Foreign Application Priority Data

Jun. 8, 2018 (DE) ..... 10 2018 209 189

(51) Int. Cl.

| | |
|---|---|
| ***H04R 25/00*** | (2006.01) |
| ***H01Q 1/24*** | (2006.01) |
| ***H01Q 1/27*** | (2006.01) |
| ***H01Q 1/52*** | (2006.01) |
| ***H01Q 7/08*** | (2006.01) |

(Continued)

(52) U.S. Cl.

CPC ..... *H04R 25/554* (2013.01); *H01Q 1/24* (2013.01); *H01Q 1/273* (2013.01); *H01Q 1/526* (2013.01); *H01Q 3/2635* (2013.01); *H01Q 7/06* (2013.01); *H01Q 7/08* (2013.01); *H04R 25/552* (2013.01); *H01Q 1/245* (2013.01); *H01Q 3/2611* (2013.01); *H01Q 3/2629* (2013.01);

(Continued)

(58) Field of Classification Search

CPC .... H04R 25/55; H04R 25/552; H04R 25/554; H04R 25/602; H04R 2225/021; H04R 2225/49; H04R 2225/51; H01Q 1/24; H01Q 1/243; H01Q 1/245; H01Q 1/273; H01Q 1/526; H01Q 7/06; H01Q 7/08; H01Q 3/24; H01Q 3/26; H01Q 3/2605; H01Q 3/2629; H01Q 3/2635; H01Q 21/245

USPC ..... 381/315, 331; 343/720, 730, 795, 807, 343/818, 833, 834, 841, 895, 700 MS

See application file for complete search history.

(56) References Cited

U.S. PATENT DOCUMENTS 8,644,542 B2 * 2/2014 Klemenz ..... H04R 25/554 381/323

9,191,757 B2 11/2015 Bauman et al.

(Continued)

FOREIGN PATENT DOCUMENTS

EP 1601051 A2 * 11/2005 ..... H01Q 21/28

EP 2672733 A1 12/2013

(Continued)

*Primary Examiner* — Jesse A Elbin

(74) *Attorney, Agent, or Firm* — Laurence A. Greenberg; Werner H. Stemer; Ralph E. Locher

(57) ABSTRACT

An antenna for inductively transmitting information and/or energy, in particular a hearing aid antenna, has a foil-like antenna base body that has a central coil core section that holds a first coil, and outer antenna sections arranged opposite one another on both sides of the central coil core section. The outer antenna sections respectively have an edge-side coil core section that adjoins the central coil core section and holds a second coil. The outer antenna sections are at an angle relative to the central coil core section. There is also described a device, in particular a hearing device, which is preferably a hearing aid, with such an antenna.

20 Claims, 8 Drawing Sheets

(51) Int. Cl.
*H01Q 7/06* (2006.01)
*H01Q 3/26* (2006.01)

(52) U.S. Cl.
CPC .... *H04R 2225/021* (2013.01); *H04R 2225/49* (2013.01); *H04R 2225/51* (2013.01)

(56) References Cited

U.S. PATENT DOCUMENTS

| | | | | |
|---|---|---|---|---|
| 2003/0025478 | A1* | 2/2003 | Zink | H01M 10/46 320/108 |
| 2006/0022886 | A1* | 2/2006 | Hein | B82Y 25/00 343/787 |
| 2008/0095387 | A1* | 4/2008 | Niederdrank | H01Q 1/273 381/314 |
| 2009/0295663 | A1 | 12/2009 | Sato | |
| 2011/0156978 | A1 | 6/2011 | Ito et al. | |
| 2014/0363037 | A1* | 12/2014 | Nikles | H01Q 1/22 381/328 |
| 2016/0365751 | A1 | 12/2016 | Hatanaka et al. | |
| 2018/0221673 | A1* | 8/2018 | Kuang | A61N 1/37229 |
| 2019/0006757 | A1 | 1/2019 | Nikles et al. | |

FOREIGN PATENT DOCUMENTS

| | | | |
|---|---|---|---|
| EP | 2824942 | A1 | 1/2015 |
| JP | 2007028114 | A | 2/2007 |
| JP | 2009296107 | A | 12/2009 |
| JP | 2015159664 | A | 9/2015 |
| JP | 3113316 | A | 1/2017 |
| WO | 2010013992 | A1 | 2/2010 |
| WO | 2017153274 | A1 | 9/2017 |

* cited by examiner

ANTENNA AND DEVICE WITH SUCH AN ANTENNA

BACKGROUND OF THE INVENTION

Field of the Invention

The invention relates to an antenna for inductively transmitting information and/or energy, having a foil-like antenna base body with a central coil core section that holds a coil. The invention also relates to a device, in particular a hearing device, that has such an antenna. The hearing device is preferably a hearing aid.

For example, people who suffer from hearing loss may use a hearing aid as an assistive device. The sound or a sound signal from the environment is recorded by an electromechanical sound transducer, which converts the sound or the sound signal into an electrical signal (audio signal). The electrical signal is processed by an amplifier circuit and converted by another electromechanical transducer into an amplified sound signal that is introduced into the person's ear canal.

Different implementations of hearing aids are known. "Behind-the-ear" devices are worn between the skull and the auricle, with the amplified sound signal being introduced into the person's ear canal by means of a sound tube. Another implementation of a hearing aid is an "in-the-ear" device in which the hearing aid itself is inserted into the ear canal. As a result, the ear canal is at least partially closed so that, with the exception of the sound signal the hearing aid produces, no other sound, or only strongly attenuated sound, may penetrate into the ear canal.

If the person suffers from a hearing impairment in both ears, a hearing aid system with two such hearing aids is used, each ear being associated with one of the two hearing aids. To enable the person to hear spatially or to improve spatial hearing, it is necessary that the audio signals captured by means of one hearing aid are made available to the other hearing device. Information is transmitted wirelessly between the two hearing aids by means of an antenna. The transmitted information is increasingly attenuated as the frequency increases, because of the person's head. In consequence, in particular, inductive information transmission is used, for example with a frequency between 1 kHz and 300 MHz.

WO 2017/153274 discloses an antenna, in particular an antenna of a hearing aid, for radio communication. This antenna comprises a coil core extending along a longitudinal direction, which holds a number of turns, as well as a first screen made of a ferrimagnetic and/or ferromagnetic material, which is at an angle to the longitudinal direction of the coil core and is flat at one end face of the coil core. According to a refinement of the antenna, a second flat screen is arranged at the end face facing away from the first screen, which is at an angle relative the longitudinal direction of the coil core.

During operation, such an antenna for inductive information transmission generates a magnetic field with a magnetic dipole moment. The antenna is stationary and oriented in a (transmitting) spatial direction with respect to the antenna. To achieve the strongest possible inductive coupling and thus the best possible transmission quality between the antenna and a receiver, in particular an antenna or coil of a second hearing aid or accessory, the receiver must have a corresponding orientation (alignment) with respect to the direction of the transmitting space. In particular, a (receiving) surface of the receiver is oriented perpendicular to the direction of the transmitting space in order to produce induction.

Information is inductively transmitted or exchanged between the hearing device or between at least one of the hearing devices of a hearing aid system and the accessory, such as a remote control or a relay station for coupling the hearing device to another apparatus such as a mobile telephone. The hearing aid may be rotated relative to the accessory, for example by turning the head. In that case, the receiver, which is typically arranged rigidly in or on the accessory, is likewise moved or rotated. Consequently, the magnetic field generated by the antenna and in particular its magnetic dipole moment is rotated relative to the receiver so that inductive coupling and, accordingly, information transmission is comparatively reduced or even brought substantially to zero compared to the optimal position of the receiver with respect to the spatial direction of the magnetic dipole.

Analogously, this problem also occurs with other devices, such as a sensor (sensor systems), a computer system worn on the body (wearable computer, wearables), a component of a sensor or actuator system worn on the body (Body-area-network) or hearing devices, such as headphones or a headset. For example, a second antenna may be used in addition to the (first) antenna, the direction of the transmitting space of the second antenna is oriented at an angle to the direction of the transmitting space of the first antenna. The second antenna in the device is preferably arranged at a distance from the first antenna and oriented in such a way as to prevent mutual interference. For example, a second antenna requires additional installation space; as a result, a comparatively complex structure is required, or even a structure that is inapplicable for the device's intended use.

BRIEF SUMMARY OF THE INVENTION

The object of the invention is to of specify an antenna that enables a comparatively reliable inductive coupling with a receiver even with different spatial orientations. A device with such an antenna will also be provided, along with a method of operating such an antenna.

With regard to the antenna, this problem is solved according to the invention as claimed. With regard to the method, this problem is solved according to the invention as claimed; and with regard to the device, this problem is solved according to the invention as claimed. Advantageous configurations and refinements are the subject matter of the dependent claims.

The antenna is suitable, in particular intended and/or arranged, to be used in inductively transmitting information and/or energy. For example, the antenna is a component of a hearing device, in particular a hearing aid. The antenna has a foil-like, preferably continuous, antenna base body with a central coil core section and outer antenna sections that are arranged opposite each other on both sides of the central coil core section. The central section of the coil core holds a first coil (the main coil). Preferably, the outer antenna sections are flat. In addition, the outer antenna sections each have an edge-side coil core section that adjoins the central coil core section and holds a second coil (secondary coil). For example, the first and second coils have different winding numbers.

The outer antenna sections are at an angle relative to the central coil core section. As a result, the first coil and the two second coils are oriented in different spatial directions; in other words, the coil axes of the first and the two second coils are at an angle relative to each other. For example, an angle between the central coil core section and the respective outer antenna section is between 80° and 130° or in particular between 85° and 110°. Particularly preferred, however, are edge-side coil core sections that are oriented perpendicular to the central coil core section, forming a U-shape. Thus the outer antenna sections each form a leg of the U-shape and the central coil core section forms the connecting part of the U-shape. The connecting parts of the U extend in a longitudinal direction and the legs extend in a transverse direction. In this case, the two foil-like outer antenna sections extend in two parallel planes that are spaced apart from each other.

"Information transmission" denotes in particular the transmission of a signal or data, such as settings data or data that comprises information about sound recorded by the hearing aid or a sound signal that is subjected to signal processing. The energy received during energy transmission is preferably made available for charging an energy storage device, in particular a battery.

A "foil-like" object denotes an object with extension in one spatial direction that is comparatively small, compared to its extension in a plane oriented perpendicular to this spatial direction. In other words, the antenna base body is flat. The flat sides are referred to as the broad sides.

The broad sides of the central coil core section and the two outer antenna sections, which face the two outer antenna sections and the central coil core section respectively, are hereinafter also referred to as the inner side of the respective section, while the other broad sides are referred to as the outer sides. The area that the antenna base body at least partially encloses forms an inner area.

In addition, due to the angling (folding) of the outer antenna sections relative to the central coil core section and due to the foil-like, i.e. flat, design of the antenna base body, the space required is reduced, so that a comparatively compact antenna is provided that may therefore also be arranged in apparatuses that offer little installation space, in particular in a hearing aid.

The antenna base body is preferably formed from a ferromagnetic and/or ferrimagnetic material, in particular from a weakly magnetic ferrite, and has an electrical conductivity of less than $10^6$ S/m, preferably less than 100 S/m, and a magnetic permeability $\mu_r>5$, preferably $\mu_r>200$. For example, the antenna base body is formed by a foil or by means of a foil. For example, the thickness of the foil, i.e. its extension perpendicular to the broad side, is between 25 μm and 700 μm, in particular between 70 μm and 300 μm, preferably between 100 μm and 250 μm. The antenna base body is preferably bendable or foldable. As a result, the antenna base body may be angled away from a planar shape by angling the two outer antenna sections.

The first coil and each of the second coils may advantageously be switched (activated) independently of the other, i.e. supplied with electrical current in the appropriate direction. To this end, the first and second coils are expediently connected to a source of current or voltage. The first coil, one of the second coils respectively, or a combination of these coils, may be switched with a predetermined current direction. For example, in a first operating mode, the first and the two second coils may be switched simultaneously, the current direction being selected such that the magnetic fields generated by the coils are constructively superimposed, i.e. the north pole of the magnetic field that the first coil generates is arranged adjacent to the south pole of the magnetic field that a second coil generates and the south pole of the magnetic field that the first coil generates is adjacent to the north pole of the magnetic field that another second coil generates. Thus, the current flows through the coils in the same direction. In the case of such a switching of the coils with a U-shaped antenna base body, the antenna acts like a ferrite rod antenna with a comparatively large end face, with the generated magnetic dipole moment being oriented substantially perpendicular to the outer antenna sections.

For example, in a second operating mode, only one of the two second coils is switched. In the case of a U-shaped antenna base body, the magnetic dipole moment generated is not perpendicular to the outer antenna sections, but is tilted at an angle relative to the normal of the outer antenna sections.

In sum, the direction of the transmitting space or the orientation of the magnetic dipole moment generated by the antenna relative to the antenna is not stationary (rigid), but differently oriented spatially depending on how the coils are switched. In other words, a radiation characteristic of the antenna may be set and indeed is set, as a function of the switching of the coils. In other words, the magnetic field that the antenna generates is rotated. Thus, the orientation of the magnetic dipole moment is adjusted by activating, in particular by energizing, one of the second coils, both second coils and/or the first coil, in such a way that the strongest possible inductive coupling between the antenna and the receiver is realized. If, for example, the receiver is a coil, the first coil and second coils are energized in such a way that the magnetic dipole moment that the antenna generates is as parallel as possible to a coil axis or as perpendicular as possible to a receiving surface of the receiver.

In this case, advantageously, comparatively little installation space is required for the antenna. The antenna is also comparatively simple and may therefore be produced in a cost-saving manner.

For transmitting information and/or energy, the antenna is inductively coupled to a receiver (magnetic) based on the magnetic dipole moment generated by it, the receiver being in particular a second antenna or a coil. In particular, the receiver is an accessory such as a remote control or a relay station, particularly one worn on the body.

When this receiver is rotated relative to the direction of the transmitting space, the strength of the magnetic inductive coupling changes. Advantageously, in particular if the magnetic inductive coupling is comparatively small, the orientation of the direction of the transmitting space may be changed by changing the switching (control), in other words by changing the intensity and/or direction of the current, in the coils. The direction of the transmitting space is preferably adjusted according to the receiver's changed spatial orientation. For example, the magnetic dipole moment of a receiver designed as a coil is aligned parallel to the coil axis of the receiver. Even if the magnetic dipole moment cannot be completely adjusted to correspond to the receiver, for example in case of a comparatively strong rotation of the receiver with respect to the antenna, in particular 90° with respect to the antenna, it is possible that a comparatively large component of the magnetic dipole moment contributes to the magnetic coupling due to the change of the spatial orientation of the magnetic dipole moment. In summary, the magnetic inductive coupling may be, and is, adjusted by changing the spatial orientation of the magnetic dipole in such a way that sufficient information transmission is realized.

For example, the apparatus having the receiver, in particular the accessory, or alternatively a device having the antenna, in particular the hearing aid, has an evaluation unit (signal processing unit) that determines the strength of the inductive coupling by means of a suitable algorithm, such as for example a channel estimation algorithm or the so-called BER evaluation (bit error rate evaluation), so that, as a function of the result of this determination, the switching or activation of the coils is changed if such a change is necessary for sufficient transmission quality between the antenna and the receiver.

According to an advantageous refinement, each of the two outer antenna sections has a flange section, which in particular has the shape of an arc of a circle. This section adjoins the free end face of the edge-side coil core section, i.e. the end face that is opposite and/or turned away from to the central core section. In other words, the outer antenna section is extended, in particular in the shape of a circular segment, from the free end face of its edge-side coil core section, the edge-side coil core section and the flange section extending in a common plane. In other words, if the extension is in the shape of an arc of a circle, the outer antenna section is mushroom-shaped. Alternatively, the extension may be rectangular, T-shaped, circular or ring-shaped. An effective antenna area is advantageously extended or enlarged by means of the flange areas.

According to a particularly advantageous refinement, the antenna has a foil-like shielding, preferably consisting of a single piece. This shielding is respectively arranged on the side of the two outer antenna sections that faces the central coil core section and on the side of the central coil core section that faces the outer antenna sections. In other words, the shielding is arranged on the respective inner side of the outer antenna sections and central coil core section.

According to a refinement, the shielding is larger than or equal in size to the antenna base body and covers it. In other words, the extension of the shielding in a plane parallel to the outer antenna sections and the central coil core section, respectively, is greater than or equal to the extension of the outer antenna section and central coil core section.

Preferably, the shielding has an electrical conductivity greater than $10^6$ S/m. In addition, the shielding has a (magnetic) permeability $\mu_r<1000$, in particular $\mu_r<100$, preferably $\mu_r<2$. The shielding is therefore made of a diamagnetic ($0\leq\mu_r<1$) or paramagnetic ($\mu_r>1$) material, in particular copper, or contains diamagnetic or paramagnetic material. The thickness of the shielding is chosen in such a way that the magnetic field generated by the antenna does not penetrate the shielding. For example, the shielding has a thickness between 0.25 and 1.5 times the penetration depth of the magnetic field for the shielding material.

Preferably, the permeability of the antenna base body is greater than the permeability of the shielding, and the electrical conductivity of the shielding material is expediently greater than the electrical conductivity of the antenna base body. The magnetic field does not penetrate the shielding, in particular due to a current and corresponding magnetic counter-field induced in the surface of the shielding according to Lenz's law; instead, it is forced out of it. The magnetic field is forced into the antenna base body and thus runs substantially therein. Thus, the shielding prevents the magnetic field lines from spreading into the inner area. As a result, the effective permeability of the antenna base body and the sensitivity of the antenna are advantageously increased.

The sensitivity and quality of the antenna may be adapted to the operational requirements by the implementation of the antenna base body, and in particular its extension relative to the shielding. For example, outer antenna sections that are reduced in size relative to the shielding cause an improved quality of the antenna with advantageously only slightly reduced sensitivity. In particular, the magnetic field lines are deflected away from the inner area, or penetration of the magnetic field lines into the inner area is avoided. An outer antenna section that is reduced in size relative to the shielding means that a projection of the outer antenna sections onto the shielding is completely covered by the shielding.

The spatial orientations of the magnetic dipole moment that the antenna generates may be realized by means of a corresponding circuit or control of the coils, and depend on the antenna design, in particular on the angle between the central coil core section and the respective outer antenna section, the shape of the flange sections and the shape of the shielding. If typical or comparatively frequently occurring rotations are envisioned or expected between the antenna and the receiver during operation, the antenna is preferably arranged in an apparatus that holds it, such as a hearing aid, in such a way that such rotations may be and are compensated for as far as possible by means of a corresponding change in the magnetic dipole moment—taking into account the design of the antenna and thus the spatial orientations that may be realized—so that the inductive coupling is or remains as strong as possible. For example, turns of a person's head typically occur more frequently and/or at a larger angle than an inclination of the head. The antenna is then preferably arranged in a hearing aid in such a way that the best possible (strong) inductive coupling between the antenna of the hearing aid and the receiver of an accessory during such rotations is made possible by appropriately adjusting the spatial orientation of the magnetic dipole moment for these rotations.

For example, the first coil and/or second coils are wound by means of a winding machine around the antenna base body, which is formed from a foldable foil that has not yet been folded, and the coils are connected to corresponding electrical connections, for example by means of bonding. For example, the shielding is designed as a copper foil and is then arranged on the antenna base body, and the antenna base body and copper foil are folded. Alternatively, the antenna base body is formed using a ferrite core that is rigid and has already been angled. The first coil is applied using the winding machine. The second coils are prewound and then attached to the edge-side coil core sections. If the outer antenna sections have flange sections, these flange sections are designed in such a way that the second coils may be plugged into the edge-side coil core sections via these flange sections.

Alternatively and preferably, however, the antenna base body is integrated into the printed circuit board, according to suitable refinement. In the course of manufacturing the antenna, the shielding is glued onto the side of the printed circuit board that is designed to face the inner area.

In another alternative, the shielding and the antenna base body are integrated into a printed circuit board that is preferably flexible. At best, a first winding layer and a second winding layer are arranged on opposite broad sides of the antenna base body. In other words, the antenna base body, first winding layer and second winding layer are stacked on top of each other. The antenna base body and the winding layers form layers of the printed circuit board in particular. For example, in the course of manufacturing the printed circuit board, the layers are glued or laminated onto a substrate or onto one of the layers.

These layers each have a number of conductor paths by means of which the windings of the first coil and the windings of the second coil are formed. The conductor paths are substantially perpendicular to the longitudinal or transverse direction. The conductor paths of the two winding layers are electrically (galvanically) interconnected by means of through connections (vias), which suitably extend perpendicular to the broad side of the antenna base body, forming the corresponding coil. For example, in the course of manufacturing the printed circuit board, the conductor paths are etched or lithographed into the corresponding winding layer.

Expediently, the shielding is formed by means of a copper layer of the printed circuit board and is arranged on the side of the antenna base body that faces the inner space and on the broad side of the first winding layer that faces away from the antenna base body. In the course of manufacture, the antenna base body and/or the winding layers are applied, for example, by means of lamination or alternatively by means of coating. For example, the antenna base body and/or the winding layers are applied to one of the layers or to a carrier structure.

For example, the winding layers are only formed in the area of the central coil core section and the edge-side coil core sections. Alternatively, the winding layers completely cover the antenna base body, namely the entire area of the antenna base body.

The printed circuit board, for example, has a (thickness) extension perpendicular to its broad side between 75 μm and 850 μm, in particular between 120 μm and 450 μm, preferably between 150 μm and 400 μm. As detailed above, for example, the antenna base body integrated into the printed circuit board has a thickness between 25 μm and 700 μm, in particular between 70 μm and 300 μm, preferably between 100 and 250 μm.

Advantageously, a substantially field-free area is formed, in particular centrally, on the inner sides of the shielding that is arranged on the outer antenna sections. Advantageously, an electrical or electronic component of a device having the antenna may be connected here. For example, the electronic device component is a charging electronics in the form of a charging chip, a radio system chip and/or connections for an energy storage device. The electronic device component is preferably arranged centrally on the side (surface) of the printed circuit board that faces the inner area of a section of the printed circuit board in which the outer antenna sections are integrated. As a result, the electronic component is substantially positioned in a field-free manner and is not disturbed or only slightly disturbed by the magnetic fields. In addition, such an electronic component does not disturb a signal-to-noise ratio of the antenna during operation or does so only to a comparatively small extent; in other words, the antenna and the electronic device component have a comparatively low crosstalk. The electronic device component may also be easily and inexpensively applied to the printed circuit board, for example by reflow soldering.

According to an advantageous configuration, the antenna has a third winding layer and fourth winding layer that are arranged on the broad side of the first winding layer facing away from the antenna base body or on the broad side of the second winding layer facing away from the antenna base body. In this case, the third winding layer is expediently arranged between the first winding layer and the shielding. The third winding layer and the fourth winding layer have conductor paths analogous to those of the first winding layer and second winding layer. A third coil is formed that is arranged concentrically with respect to the first coil or one of the second coils, by means of the conductor paths of the third winding layer and the conductor paths of the fourth winding layer. In other words, the third coil is another first coil or another second coil. As an example, three third coils built in an analogous manner, which are arranged concentric to first coil or to both second coils. These coils may preferably be switched or controlled independently of each other. In this way, the direction of the antenna transmitting space may be adjusted and set more precisely when the coils are switched on (current supply, control). Alternatively, the third coil is galvanically interconnected with the corresponding first coil or corresponding second coil, forming a single winding.

Alternatively or in addition, one or more additional first coils is/are carried by the central coil core section, the additional first coils being arranged next to each other in the longitudinal direction, or in the longitudinal direction of the coil. Alternatively or in addition, one or more additional second coils are carried by one or both edge-side coil core sections, with the additional second coils being arranged next to each other in the transverse direction or in the longitudinal direction of the coil. These coils may likewise be switched independently of each other, so that with a corresponding switching of the coils the direction of the antenna transmitting space may be and indeed is set more precisely.

Advantageously, (electrical) contacting of the coils during production is comparatively simple. In particular, no additional work step for making electrical contacts is necessary; instead, this is already taken into account in the design (layout) of the printed circuit board. Space requirements are advantageously reduced because the contacting of the coils does not require a solder pad.

For example, in a similar way, the printed circuit board has additional winding layers for forming an additional coil that is arranged concentrically to the first coil and third coil, or to the second coil and third coil.

With a flexible printed circuit board, it is possible to bend (fold) the board and thus the integrated antenna base body during assembly or manufacture. In addition, when integrating the shielding and antenna base body into an in particular flexible printed circuit board, the antenna is designed to be relatively stable and may therefore be mounted in a device with comparatively little effort.

As an alternative to integrating both the shielding and the antenna base body, only the shielding is integrated into the printed circuit board. The printed circuit board, in this case, is expediently arranged on the side of the antenna base body and coils that faces the inner area.

In an advantageous configuration, a device has an antenna in one of the variants described above. In particular, the antenna is used for wireless inductive transmission of information and/or energy, the antenna having a first coil that is wound around a central coil core section of a foil-like antenna base body, and second coils that are wound at an angle, in particular 90°, relative to the first coil, around a respective edge-side section of the coil core of the foil-like antenna base body.

The device is, for example, a sensor (sensor system) such as a monitor for blood pressure, blood sugar or heart rate, or a computer system worn on the body (wearable computer, wearables) or a component of a sensor or actuator system worn on the body (body-area network). In particular, the device is a hearing device, such as headphones or a headset, and preferably the device is a hearing aid. For example, the hearing aid may be a receiver-in-the-canal (RIC) hearing aid, in-the-ear (ITE) hearing aid, in-the-canal (ITC) hearing aid, complete-in-canal (CIC) hearing aid, or behind-the-ear (BTE) hearing aid worn behind an auricle. The hearing aid may be part of a (binaural) hearing aid system, each of a person's ears being respectively associated with such a hearing aid. An accessory, such as a remote control or a relay station that the person may wear, which is at least intermittently inductively coupled to the device for inductively transmitting information and/or energy, may be associated with the device, in particular the hearing aid. The accessory device, for example, likewise has an antenna in the above-described variant.

For example, the outer antenna sections extend over other areas of the device, for example even over the entire device. Due to the foil-like implementation, the antenna is thus enlarged in a space-saving and cost-effective manner, and as a result, a bandwidth or the quality as well as the sensitivity of the antenna may be adapted to the operational requirements.

According to an advantageous refinement, the antenna at least partially encloses a device component. The device component is thus arranged in the inner area of the antenna. A space-saving embodiment is created by arranging the antenna practically directly on the device component. As a result, the device, which is designed in particular as a hearing device, may be made smaller while the sensitivity of the antenna remains the same, or additional components may be incorporated into the device.

The outer antenna sections, in particular their flange sections, are for example adapted to a shape of the device component. For example, the flange section is not flat, but curved. Alternatively, the flange section has a recess, for example for contacting the device component.

In particular, the device component is an energy storage device such as a battery, in particular a lithium-ion battery, which supplies energy to the hearing device. The antenna serves to inductively transmit energy, so that in a certain operating mode of the device, the energy storage of the device may be wirelessly charged by means of the antenna.

In particular, if the device component is designed as an energy storage, the component has substantially parallel end faces (end surfaces) that are spaced apart from one another, and a circumferential region that is formed by means of a lateral surface that is perpendicular to the end faces of the device component. The outer antenna sections are then arranged respectively at the end faces of the device component according to a suitable refinement, and the central coil core section covers the lateral surface of the device component. The outer antenna sections at least partially cover the end surface of the respective end face, preferably at least half of the end surface. The shielding also preferably completely covers the end faces of the device component.

If the end faces of the device component are not flat, but for example curved, the outer antenna sections are shaped according to the surface according to an alternative configuration; for example, they are also curved. As a result, the antenna is arranged on the device component in a particularly space-saving manner.

Due to the shielding, the magnetic field lines are prevented from spreading from the side of the outer antenna elements that faces the device component to the device component. Eddy current losses in the shielding due to an operational alternating magnetic field occur only slightly, if at all. As a result, particularly advantageously, eddy current losses and the consequent warming in the device component are avoided, which prevents damage to the hearing device component and increases its service life. If the device component is made of or surrounded by a material with a comparatively high electrical conductivity, for example copper, the magnetic field that the antenna generates is forced out of the surface of the device component due to a current induced according to Lenz's law and an associated magnetic counter-field, so that no shielding is needed between the antenna base body and the device component.

For example, the device component is also at least partially surrounded by a collar-like jacket. In other words, the jacket has an extension in the longitudinal direction that is at most equal to the extension of the peripheral area of the device component. The jacket is arranged in particular centrally between the outer antenna sections and is not necessarily (electrically) closed. The jacket is preferably a component of the shielding, but not necessarily (galvanically) connected to it. As a result of the jacket, the magnetic field lines are prevented from penetrating into the device component, so that only limited eddy current losses occur in the jacket.

BRIEF DESCRIPTION OF THE SEVERAL VIEWS OF THE DRAWING

In the following, exemplary embodiments of the invention are explained in greater detail with reference to a drawing. The drawings show as follows.

DESCRIPTION OF THE INVENTION

Corresponding parts are assigned the same reference signs in all drawings.

Figure 1:
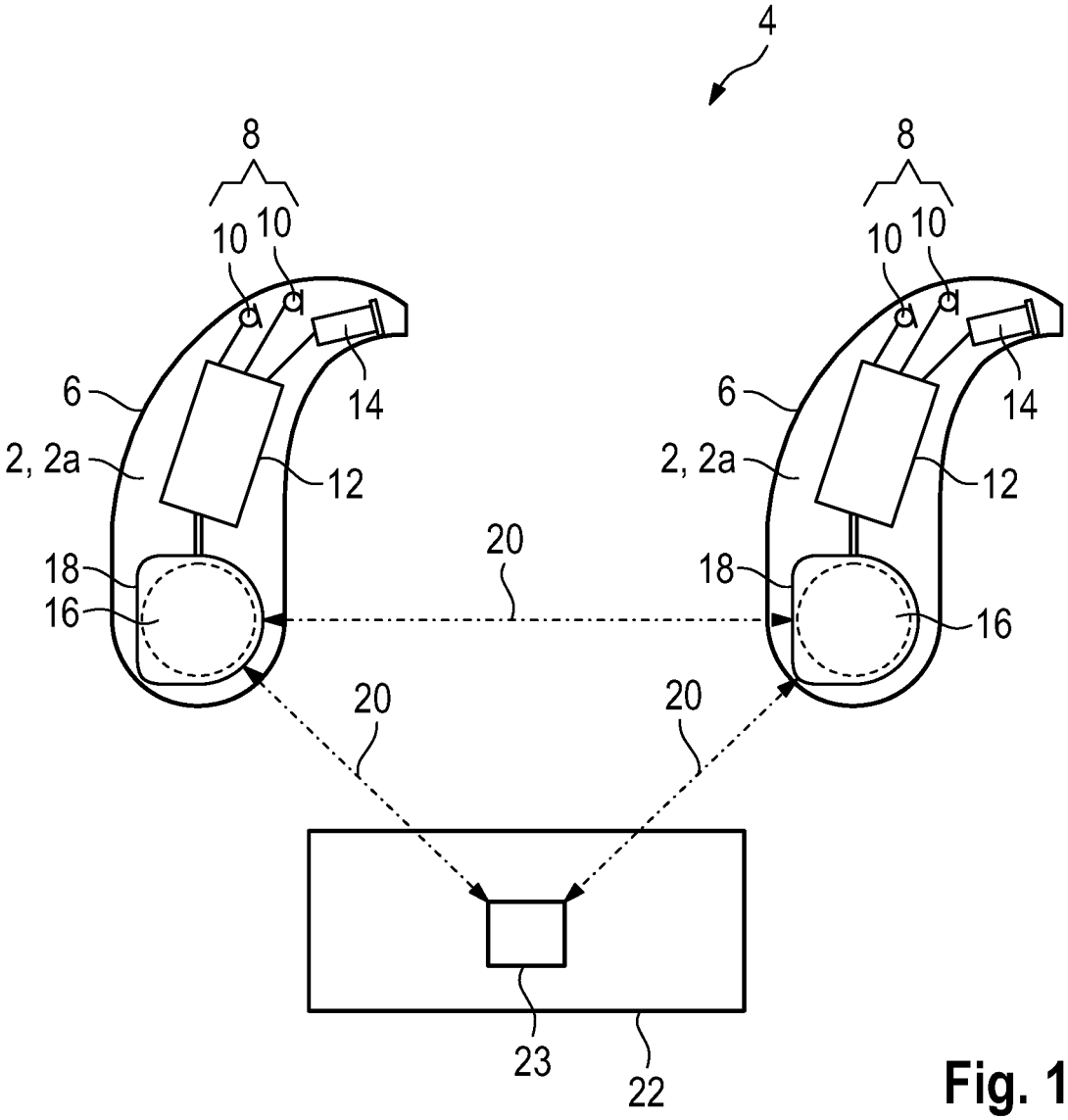
FIG. 1 Schematic drawing of two devices designed as hearing aid, each having a respective antenna that encompasses an energy storage, the two hearing aids being inductively coupled to an accessory that is rotatable relative to them, FIG. 2*a* Perspective view of the U-shaped antenna that embraces the energy storage, in which outer antenna sections of an antenna base body of the antenna are arranged at end faces of the energy storage and a central coil core section of the antenna base body partially covers a lateral surface of the energy storage, and in which a shielding is arranged between the antenna base body and the energy storage, FIG. 2*b* Side view of the U-shaped antenna according to FIG. 2*a,*

FIG. 1 shows two devices 2 that are designed as identical hearing aids 2*a* of a (binaural) hearing aid system 4. The two hearing aids 2*a* are designed and intended to for a user (wearer, person) to wear them behind each respective ear. In other words, they are behind-the-ear (BTE) hearing devices that have a sound tube, not shown, that is inserted into the user's respective ear. The respective hearing aid 2*a* comprises a housing 6 made for example of plastic. A microphone 8 with two electromechanical sound transducers 10 is arranged inside the housing 6. Using the two sound transducers 10, it is possible to change a directional characteristic of microphone 8 by changing a time offset of electrical signals that the respective sound transducer 10 generates from acquired sound signals. The two electromechanical sound transducers 10 are signal-coupled with a signal processing unit 12 that comprises an amplifier circuit. The signal processing unit 12 comprises electrical and/or electronic (active and/or passive) components and circuit elements.

In addition, a speaker 14 is signal-coupled with the signal processing unit 12, and as a result, after the signal processing unit 12 has processed the electrical signals of the sound transducer 10, they are again output as sound signals. These sound signals are conveyed to the ear of a user of the hearing device 2 via the sound tube, not otherwise shown.

A rechargeable energy storage device 16 (indicated by a dashed line) provides the power supply (voltage and current supply) of the signal processing unit 12, the microphone 8 and the speaker 14 of each hearing aid 2*a*. Each hearing aid 2*a* also comprises an antenna 18 that enables inductive information transmission 20 between the two hearing aids 2*a*. The antenna 18 partially encloses the energy storage 16. Inductive information transmission 20 between the two hearing aids 2*a* is used for exchanging data. The exchange of data, for example, enables improved directional microphony (beamforming).

The embodiment of FIG. 1 also shows an accessory part 22, which is, for example, a remote control or a relay station that the user holds. This accessory 22 has a receiver 23 that realizes an additional inductive information transmission 20, indicated by the dash-dotted arrows, with the two antennas 18 of the two hearing aids 2*a*. Inductive information transmission 20 is used to exchange data between the additional device 22 and the hearing devices 2*a*.

In addition, the antenna 18 is used for inductive and wireless energy transmission from a charger, not otherwise shown, to the hearing aid 2*a*, so that in a certain operating mode, the antenna 18 may be used to recharge the rechargeable energy storage 16 of the hearing aid 2*a*. In other words, the antenna 18 inductively transmits energy, and this energy is used to charge the energy storage device 16.

In configurations that are not shown, the devices 2 are a sensor (sensor system) such as a monitor for blood pressure, blood sugar or heart rate, or a computer system worn on the body (wearable computer, wearables) or a component of a sensor or actuator system worn on the body (body-area network). In any case, these devices 2 have an antenna 18 for inductive information transmission and, if necessary, for inductive energy transmission.

Figure 2A:
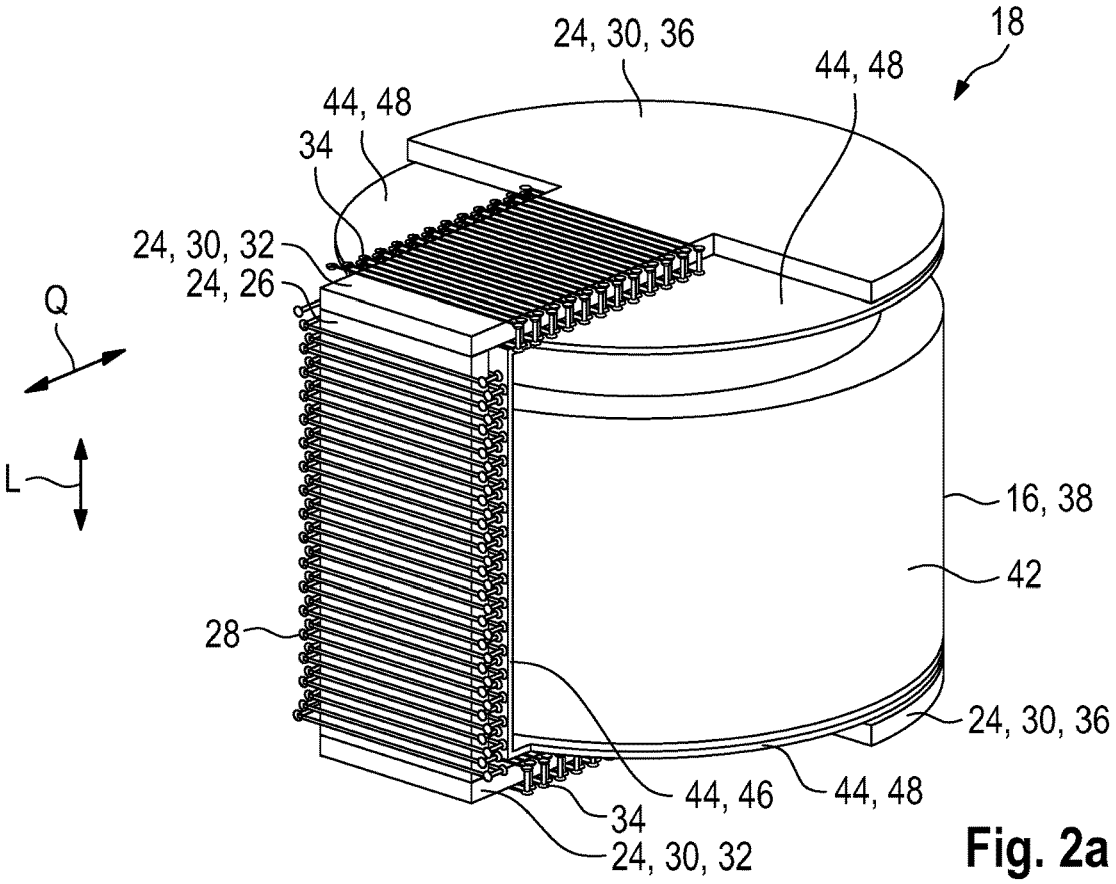
FIG. 2*c* Top view of the antenna surrounding the energy storage according to FIG. 2*a,*
Figure 2B:
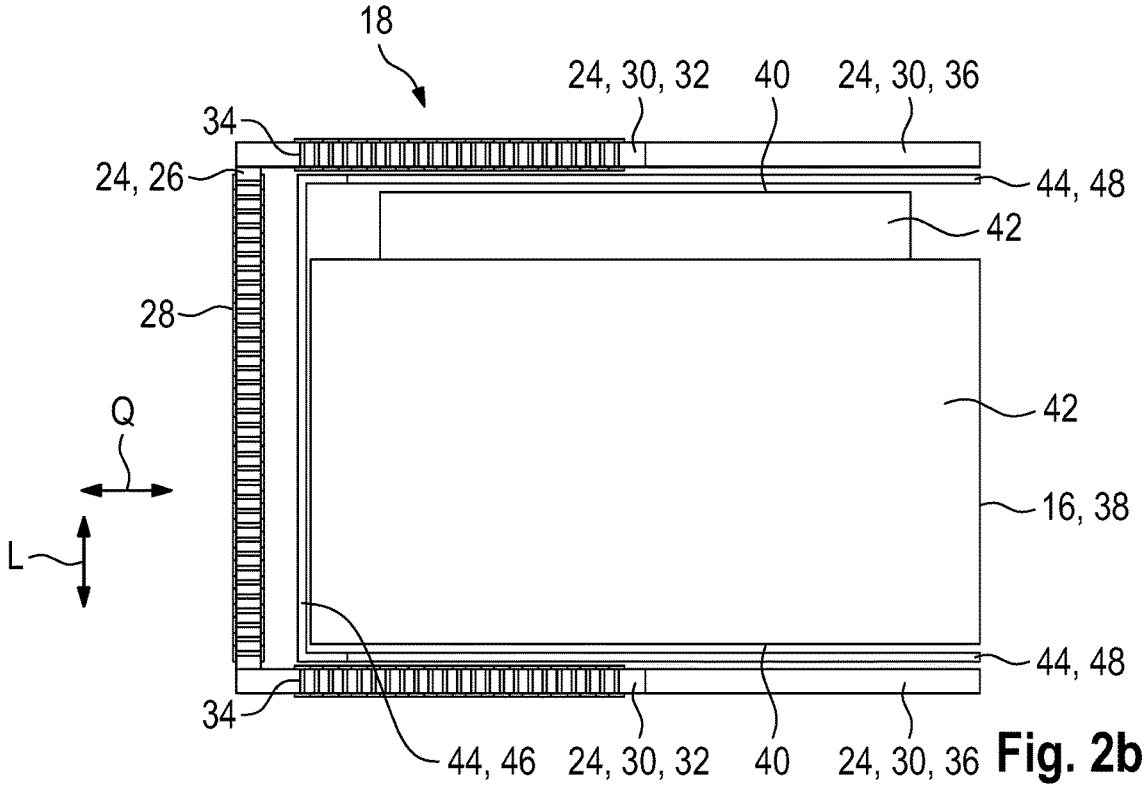
Figure 2C:
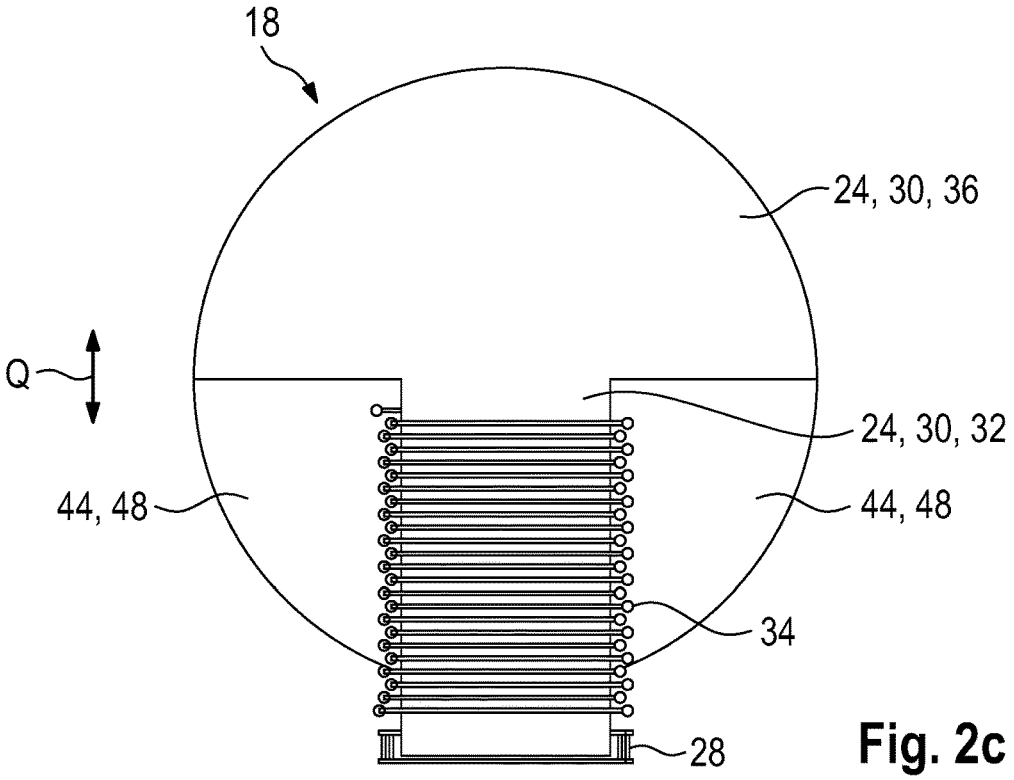

FIGS. 2*a* to 2*c* show the antenna 18 of the device 2. The antenna 18 has a foil-like antenna base body 24 formed from a weakly magnetic ferrite. The antenna base body 24 comprises a central coil core section 26 that holds a first coil 28. The central coil core section 26, and thus a coil axis of the first coil 28, extends along a longitudinal direction L. A respective outer antenna section 30 is arranged at its end faces with respect to the longitudinal direction L, so as to form a U-shaped antenna base body 24. Thus, the two outer antenna sections 30 are oriented perpendicular to the longitudinal direction L. The two outer antenna sections 30 extend in a transverse direction Q that is oriented perpendicular to the longitudinal direction L.

The two outer antenna sections 30 of the antenna base body 24 each respectively have an edge-side coil core area 32 at the edge, which adjoins the central coil core section 26. The edge-side coil core sections 32 each respectively hold a second coil 34, the coil axis of which is oriented in the transverse direction Q. In addition, the two outer antenna sections 30 each respectively have a flat flange section 36 that adjoins the free end side, i.e. the end face of the edge-side coil core section 32 that is opposite and turned away from the central coil core section 26. The outer antenna section 30 is semicircularly extended from the free end side of the corresponding edge-side coil core section 32, and the edge-side coil core section 32 as well as the flange section 36 extend in a common plane that is oriented perpendicular to the longitudinal direction L. The two outer antenna sections 30 are identical in construction and mirror-symmetrical to each other, and their plane of symmetry is perpendicular to the longitudinal direction L.

In an alternative not otherwise shown, the two outer antenna sections 30 are not identical in construction or symmetrical. Thus the flange sections 36, for example, are adapted to a shape of the device component 16 or the flange sections have, for example, a recess for contacting the device component 16.

The first coil 28 and the two second coils 34 are each respectively electrically contacted with an electronic system, not otherwise shown, or alternatively with a current source, not otherwise shown. At best, the first coil 28 and the two second coils 34 may be switched independently of each other, i.e. they may be supplied (controlled) using a provided current.

A device component 38 of the device 2 is arranged in an inner area I between the outer antenna sections 30, and this here is the energy storage 16 of the device 2 in the form of a battery. The energy storage 16 has a shape corresponding to two coaxially mounted cylinders arranged one on top of the other, the cylinder axes of which extend in the longitudinal direction L. The flat surfaces of the cylinders that are opposite and spaced apart form parallel end faces 40 of the energy storage device 16. The lateral surfaces of the two cylinders form a peripheral area 42 of the energy storage device 16. The end faces 40 of the cylinders extend in a plane perpendicular to the longitudinal direction L so that they are oriented parallel to the outer antenna sections 30. In sum, the outer antenna sections 30 are arranged at opposite end faces 40 of the energy storage device, and the central coil core section 26 overlaps the circumferential area 42 of the device component 38 that is designed as an energy storage device 16.

A foil-like shielding 44 is arranged between the antenna base body 24, namely the central coil core section 26 as well as the outer antenna section 30, and the device component 38. The shielding 44 is thus arranged on the side of the two outer antenna sections 30 that faces the central coil core section 26 and on the side of the central coil core section 26 that faces the outer antenna sections 30. The area of shielding 44 arranged on the central coil core section 26, or the area arranged between the central coil core section 26 and the energy storage 16, is referred to in the following as the central shielding section 46. Correspondingly, the two areas of shielding 44 arranged on the outer antenna sections 30 are referred to as outer shielding sections 48. In this case, the foil-like shield 44 has a conductivity of more than $10^6$ S/m and is made of or comprises diamagnetic material. According to the exemplary embodiment in FIG. 2, the shielding 44 is formed by a copper foil.

The shielding 44 is larger than the antenna base body 24 and covers it. Thus, the central shielding section 46 has an extension in a plane parallel to the central coil core section 26 that is greater than the extension of the coil core section 26. Analogously, the outer shielding sections 48 have an extension in a plane parallel to the outer antenna sections 30 that is greater than the extension of the outer antenna sections 30. The two outer shielding sections 48 completely cover the end faces 40 (end surfaces) of the energy storage 16.

The shielding prevents or at least reduces the spread of a magnetic field into the inner area I. As a result, no or at least correspondingly fewer eddy currents are induced in the energy storage 16 that is arranged in the inner area I, so that this storage is not heated or damaged.

A space-saving arrangement of the antenna 18 in the device 2 is realized by arranging the antenna 18 directly on the energy storage device 16 or on the device component 38 and by arranging the shielding 44 between the antenna base body of the antenna element 18 and the energy storage device 16. As a result, the device 2 is designed to be particularly space-saving (small).

Figure 3A:
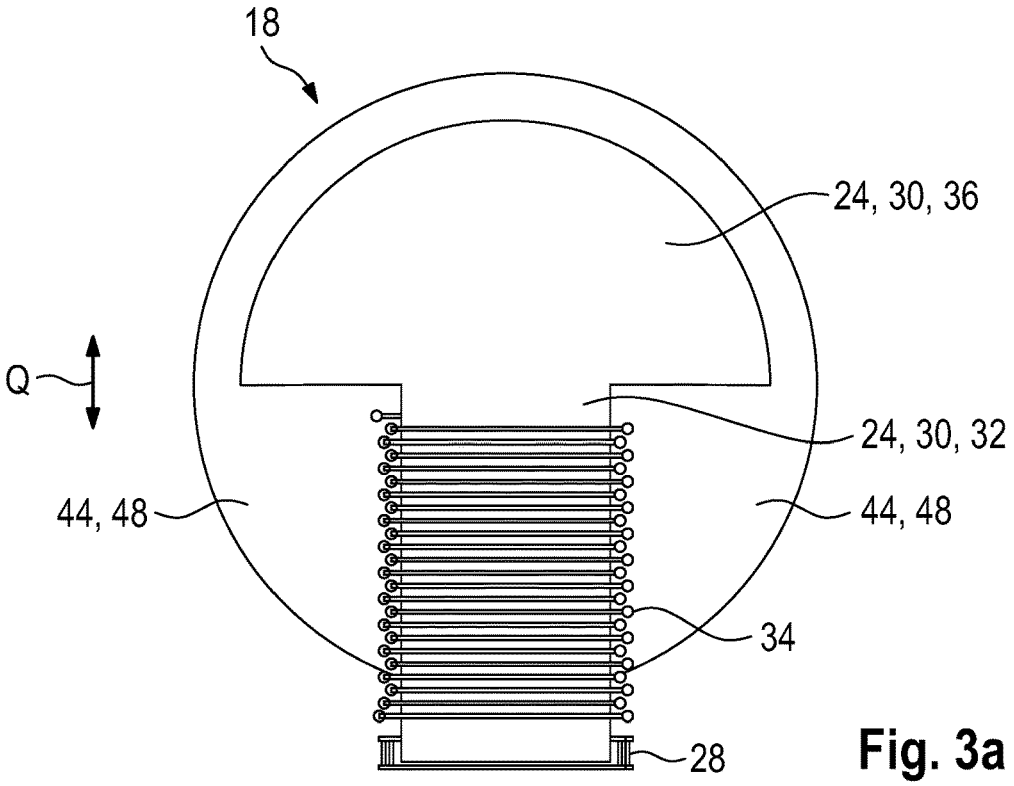
FIG. 3*a* Top view of the outer antenna section, a first alternative configuration of its circular-arc-like flange region, the flange being smaller than the shield, FIG. 3*b* A second alternative of the outer antenna section, in which the flange area is designed as a segment of a circle subtending a comparatively large central angle, FIG. 3*c* A third alternative of the outer antenna section, in which the flange area is designed as a segment of a circle subtending a small large [sic] central angle, FIG. 4 Schematic cross-section of a printed circuit board into which the antenna base body and the shielding are integrated, the first coil being formed by means of conductor paths that are introduced into winding layers that are arranged on opposite broad sides of the antenna base body, FIG. 5*a* Printed circuit board with integrated antenna base body and integrated shielding in the flat state, in the course of installing the antenna before folding it around the energy storage device FIG. 5*b* Printed circuit board according to FIG. 5*a*, in which a substrate and lacquer layer of the circuit board are not shown, FIG. 6 Exploded view of the antenna, wherein a third coil is concentrically arranged around the first coil, and a substrate and lacquer layer of the printed circuit board are not shown, and FIG. 7*a, b* Side view of the U-shaped antenna, in which a spatial orientation of a magnetic dipole moment generated during operation of the antenna is adjusted.
Figure 3B:
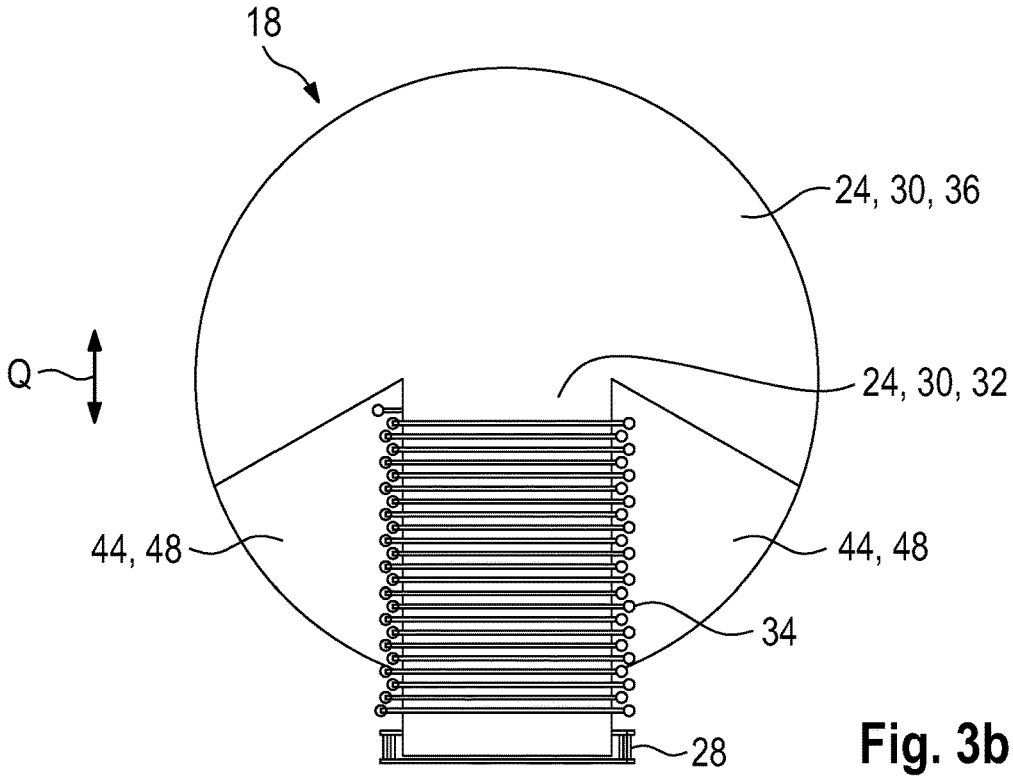
Figure 3C:
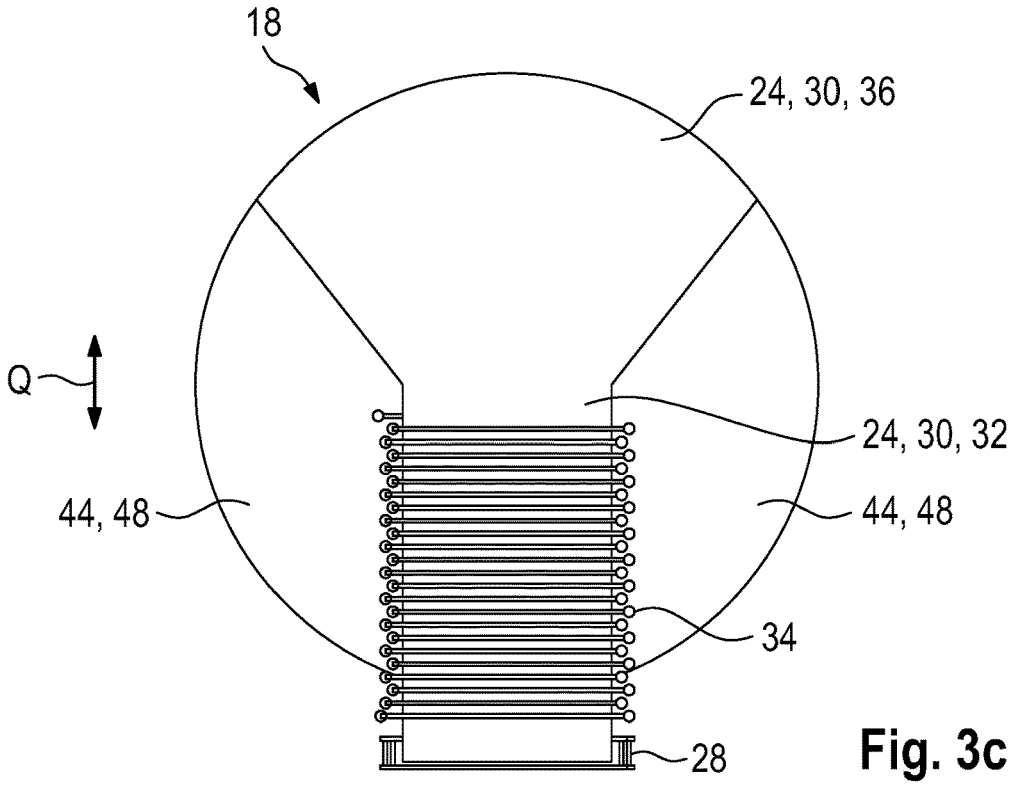

FIGS. 3*a* to 3*c* each respectively show an alternative configuration of the flange sections 36. In the first alternative shown in FIG. 3*a*, the flange section 36 formed as an arc of a circle is smaller than the shielding 44. The extension of the arc of the circle along its radial direction is smaller than the extension of the shielding 44 in this direction. In this way, the extension of magnetic field lines into the inner area I is further reduced. The second alternative according to FIG. 3*b* and the third alternative according to FIG. 3*c* have different central angles of the arc-shaped flange section 36. The flange section 36 of FIG. 3*b* has a central angle of 120°; the flange section 36 of FIG. 3*c* has a central angle of 60°. An antenna surface is adapted to operational requirements by varying the flange sections 36.

Figure 4:
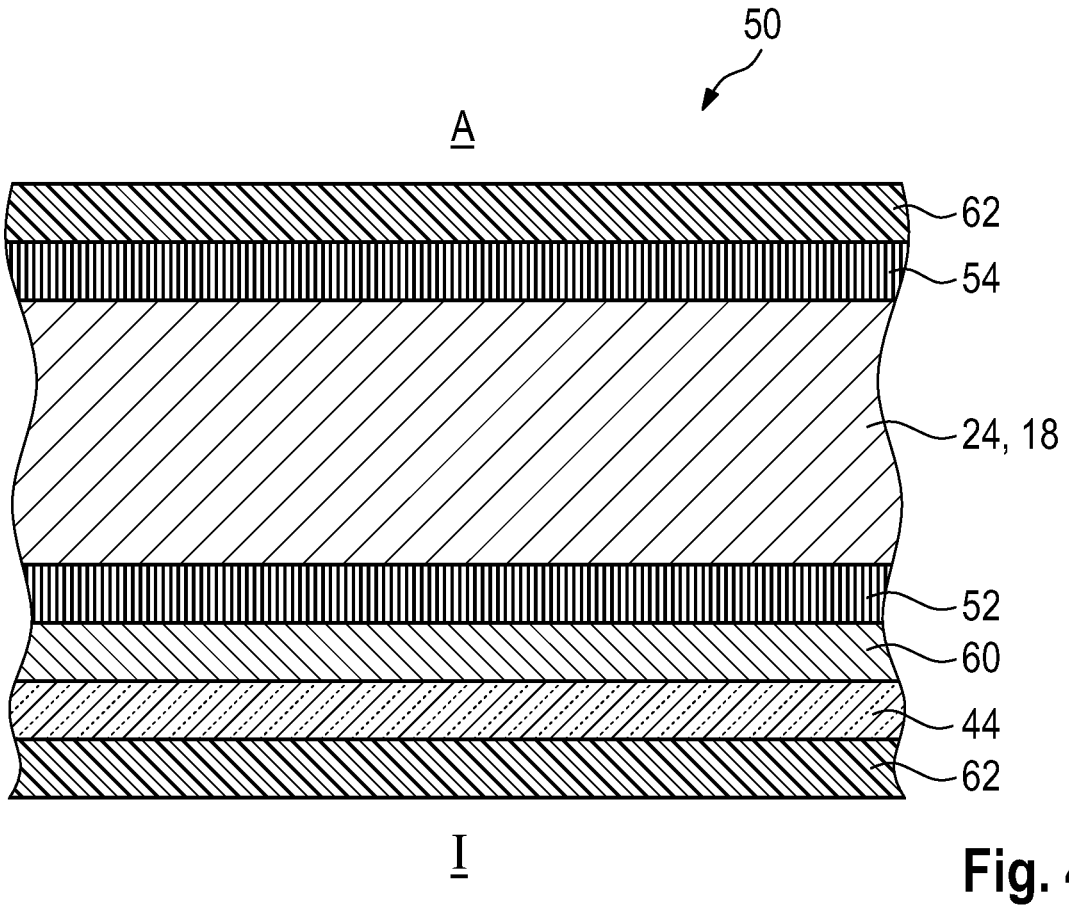

FIG. 4 schematically shows a flexible printed circuit board 50 into which the shielding 44 and the antenna base body 24 are integrated. The antenna base body 24, formed from a ferrite, is laminated into the printed circuit board 50. A first winding layer 52 and second winding layer 54 are arranged on opposite broad sides of the antenna base body 24. The first winding layer 52 and second winding layer 54 each respectively have conductor paths 56 (FIG. 5*a*), by means of which the windings of the first coil 28 and the windings of the two second coils 34 are formed. The conductor paths 56 are etched into the first winding layer 52 and second winding layer 54 during when the printed circuit board 50 is manufactured. The conductor paths 56 are electrically interconnected by through connections (vias) 58. In addition, the first winding layer 52 is arranged on or applied to a substrate 60. On the side of the substrate 60 opposite the first winding layer 52, the shielding 44 is arranged; in this case, it is formed by a copper layer of the printed circuit board 50. In this case, the shielding 44 is arranged on the broad side of the substrate 60 facing the inner area I. A lacquer layer 62 is also respectively arranged on the broad side of the shielding 44 that faces the inner area I and on the broad side of the second winding layer 54 that faces away from the inner area I, i.e. faces an outer area A.

Figure 5A:
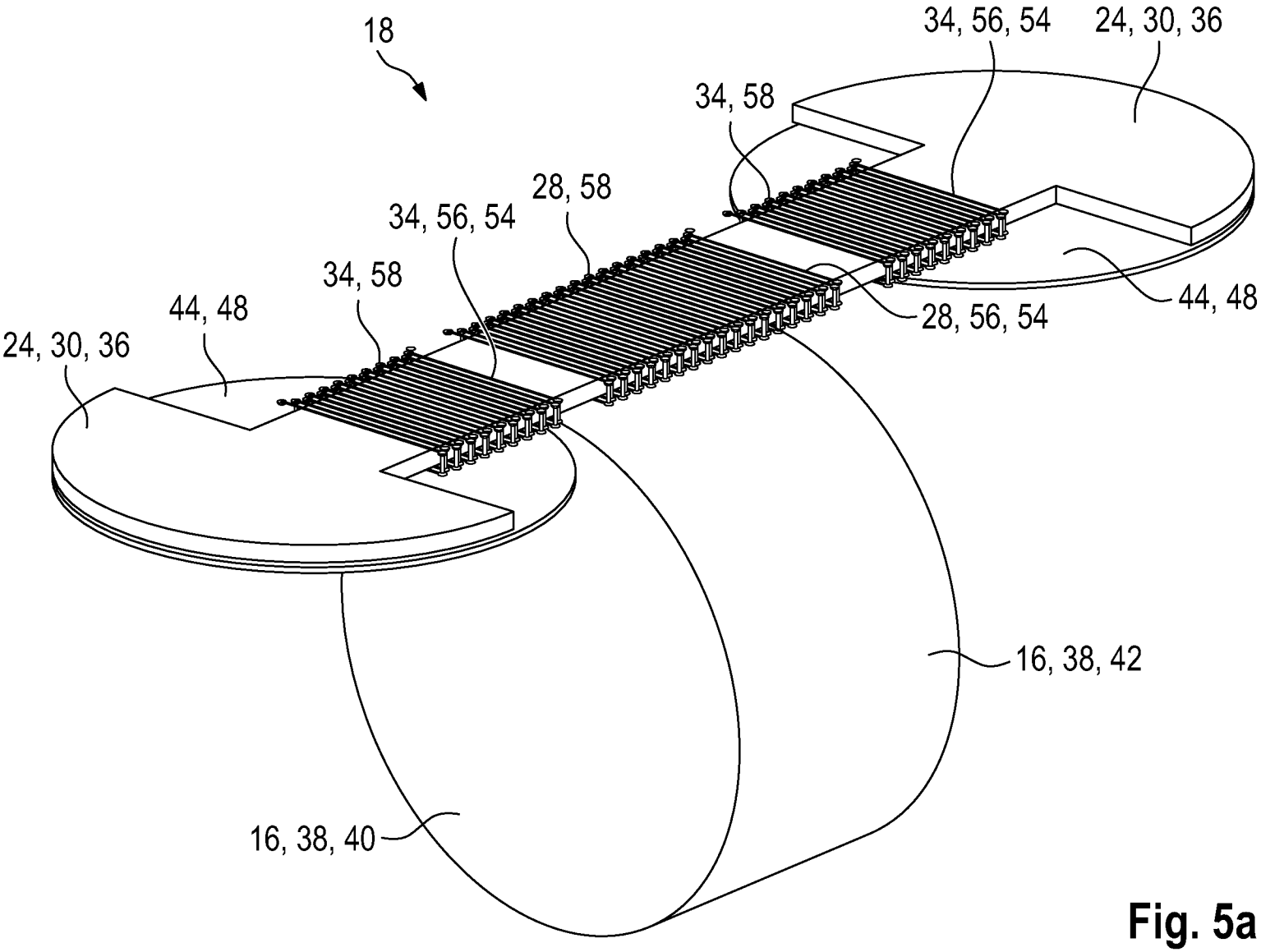
Figure 5B:
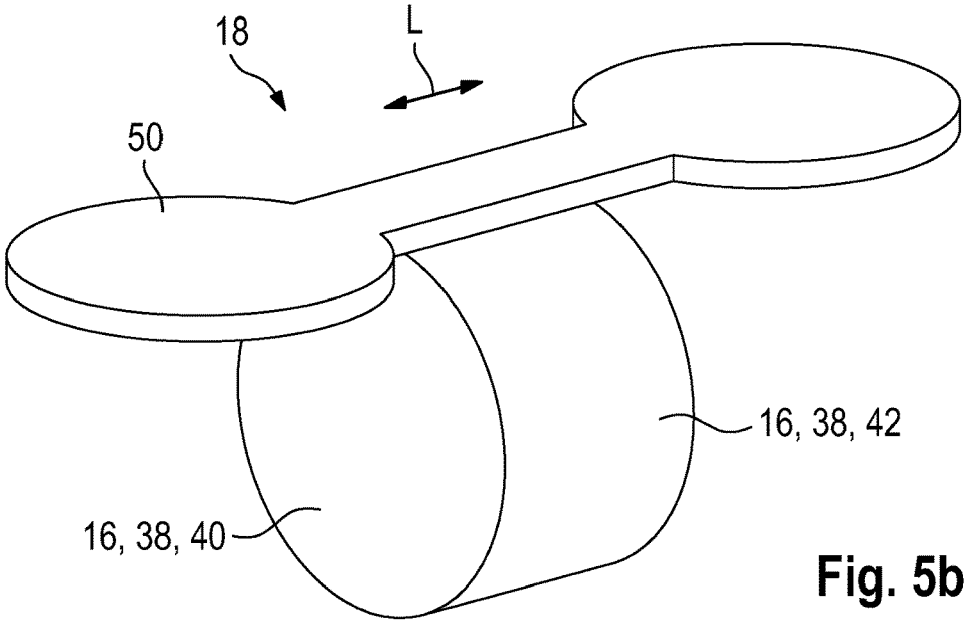

FIGS. 5*a* and 5*b* show the antenna 18 in a flat state. In the course of mounting the antenna 18 in the device 2, the antenna 18 is folded (angled) so that the antenna 18 encloses the energy storage 16 in a space-saving manner. The use of the flexible printed circuit board 50 and the foil-like and foldable design of the antenna base body 24 make this possible. The antenna base body 24 and the shielding 44 are integrated into the printed circuit board 50 according to the embodiment of FIG. 4. FIG. 5*a* shows the flexible printed circuit board 50 with integrated shielding 44 and integrated antenna base body 24; FIG. 5*a* shows this printed circuit board 50 without the substrate 60 and without the two paint layers 62, to improve the visibility of the antenna base 24 and the shield 44.

Figure 6:
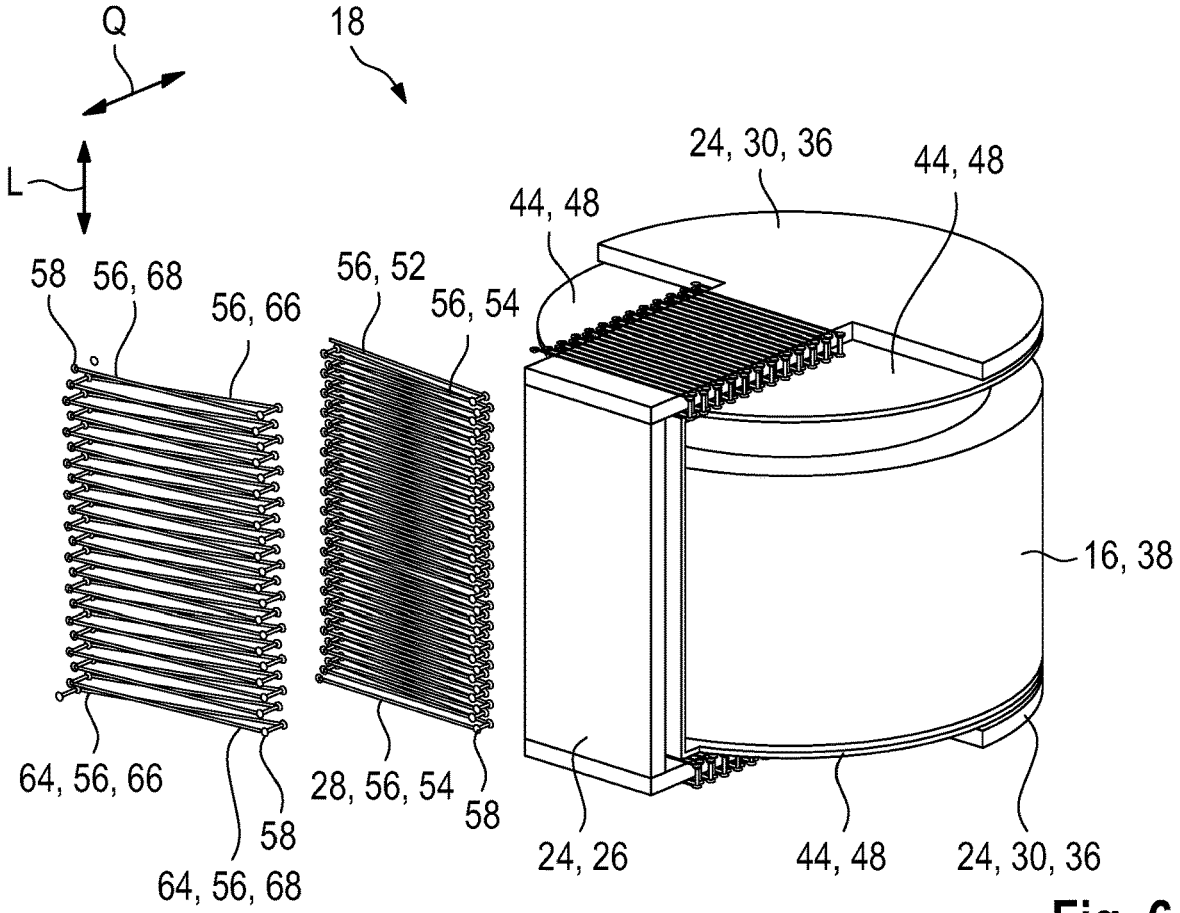

FIG. 6 shows an exploded view of the antenna 18. Here, as in FIG. 5*b*, the substrate 60 and two paint layers 62 of the printed circuit board 50, in which the antenna base 24 and the shielding 44 are integrated, are not shown, so as to improve the visibility of individual components of the antenna 18. The antenna 18 has a third coil 64, which is arranged concentrically to the first coil 28 around the central coil core section 26. This third coil 64 is formed from conductor paths 56 that are electrically connected by means of through connections 68, and are introduced into a third winding layer 66 and a fourth winding layer 68, in particular by means of etching. The third winding layer 66 or the conductor paths 56 of the third winding layer 66 are arranged on the side of the first winding layer 52 facing the inner area I and the fourth winding layer 68 is arranged on the side of the second winding layer 54 facing the outer area A.

It may also be seen that with respect to the longitudinal direction L, adjacent through connections 58 are arranged offset to each other in a direction that perpendicular to the longitudinal direction L and perpendicular to the transverse direction Q. In other words, adjacent through connections 58 are not arranged in a common plane spanned by the longitudinal direction L and transverse direction Q. The through connections 58 have a higher space requirement in the longitudinal direction L than the conductor paths 56. Due to requirements of the manufacturing or fabrication process, a minimum distance between two conductor elements is required, i.e. between two adjacent conductor paths 56, between two adjacent through connections 58 and between one conductor path 56 and the through connection 58 that which is connected to a conductor path 56 adjacent to this conductor path 56. If the through connections 58 do not have an offset arrangement, the conductors arranged spatially closest to each other will be two adjacent through connections 58. Due to the larger space requirement of the through connections 58 in the longitudinal direction L compared to the conductor paths 56, a distance between two adjacent conductor paths 56 is larger than the minimum distance. However, when the through connections 58 are staggered, the smallest distance between two conductive elements is the distance between one conductor path 56 and the through connections 58 that are connected to the directly adjacent conductor path 56. Due to the smaller space requirement in the longitudinal direction L of the conductor paths 56 compared to the through connections 58, the distance between directly adjacent conductor paths 56 is smaller when the through connections 58 are arranged at an offset, thus increasing the winding density of the corresponding coil.

Figure 7B:
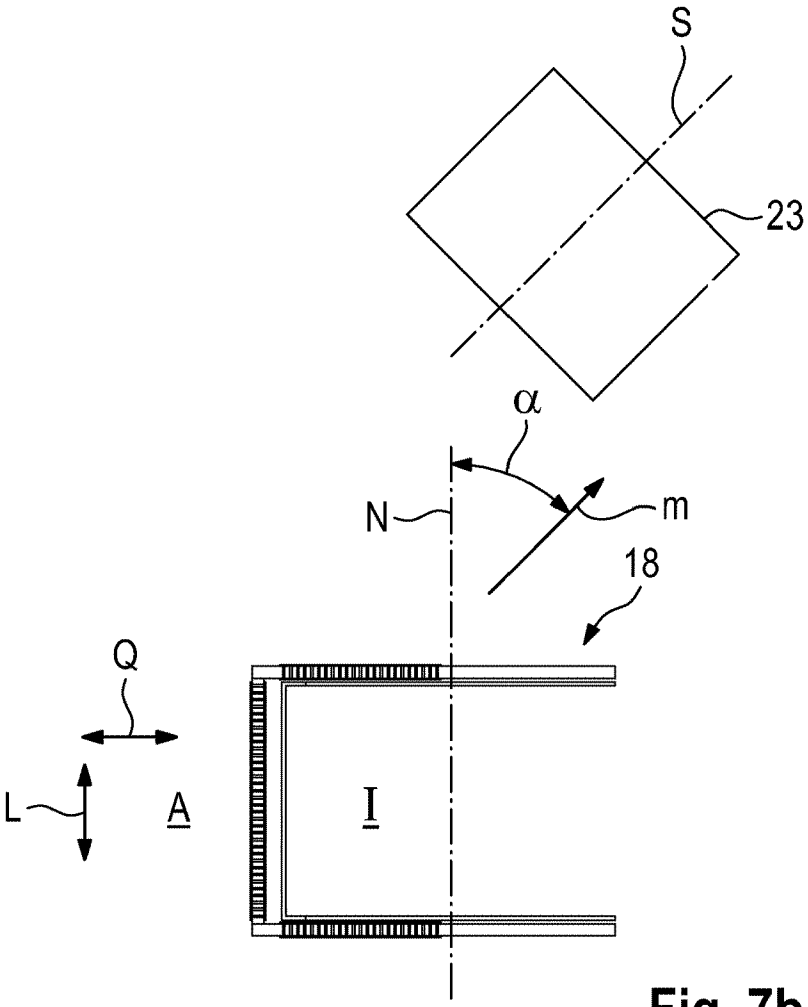
Figure 7A:
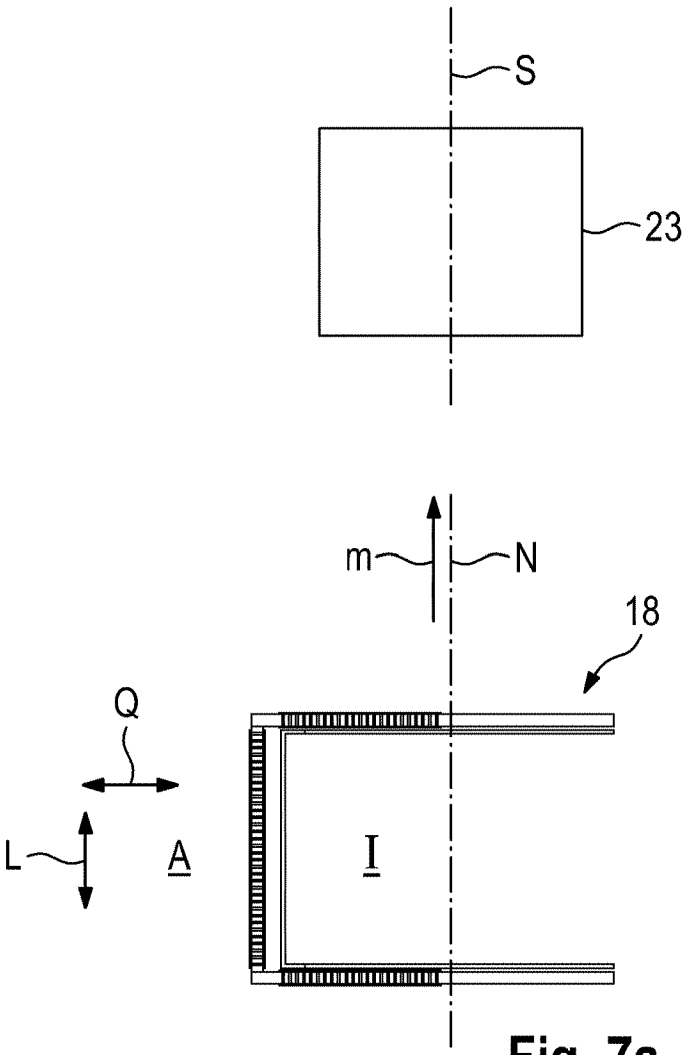

FIGS. 7*a* and 7*b* show a representative method of operating the antenna 18, which is designed according to FIG. 2. FIG. 7*a* shows a first operating mode of the antenna 18, wherein the first coil 28 and the two second coils 34 are switched simultaneously, and wherein the current direction is selected such that the magnetic fields that the coils 28 and 34 generate will overlap constructively. Thus, the coils 28 and 34 are flowed through by the current in the same direction. The antenna 18 acts like a ferrite rod antenna with a comparatively large end face, with a magnetic dipole moment m generated during operation being oriented substantially perpendicular to the outer antenna sections 30 and parallel to the longitudinal direction L.

FIG. 7*b* shows the antenna 18 in a second operating mode, in which only one of the two second coils 34 is switched. The magnetic dipole moment m generated during operation is not perpendicular to the outer antenna sections 30; instead, it is tilted at an angle α relative to the normal N of the outer antenna sections 30, in a plane spanned by means of the longitudinal direction L and the transverse direction Q.

FIGS. 7*a* and 7*b* show, next to the antenna 18, the receiver 23 of 53 accessory 22, which is designed as a coil, having a coil axis S that is oriented perpendicular to the outer antenna sections 30 of the antenna 18 or is rotated against the normal N by the angle α, respectively. An inductive coupling between the antenna 18 and the receiver 23 is maximum if the magnetic dipole moment m is oriented parallel to the coil axis S. The orientation of the magnetic dipole moment m is set by activating, in particular by energizing, one of the second coils 34, both second coils 34 and/or the first coil 28, in such a way that this extends as parallel as possible to the coil axis S.

In sum, a transmitting space direction, i.e. the spatial orientation of the magnetic dipole moment m, which is generated when the antenna 18 operates, is not stationary (rigid) with respect to the antenna 18, but has a differing spatial orientation depending on the switching of the coils 28, 34. In this way, by means of a circuit of one of the coils 28, 34, the magnetic dipole moment m generated during operation of the antenna 18 is adjusted according to an orientation of a receiver 23 relative to the antenna 18. As a result, reliable inductive coupling of the antenna 18 with the receiver 23 may be realized even when the receiver 23 is rotated relative to the antenna 18, thus ensuring reliable inductive information transmission.

The invention is not limited to the exemplary embodiments described above. Rather, a person of skill in the art may also derive other variants from this specification, without departing from the subject matter of the invention. In particular, all the individual features described in connection with the exemplary embodiments may also be combined with each other in other ways without departing from the subject matter of the invention.

LIST OF REFERENCE SIGNS

2 Device
2*a* Hearing aid
4 Hearing device system
6 Housing
8 Microphone
10 Sound transducer
12 Signal processing unit
14 Speaker
16 Energy storage
18 Antenna
20 Inductive information transfer
22 Accessory
23 Receiver
24 Antenna base body
26 Central coil core section
28 First coil
30 Outer antenna section
32 Edge-side portion of coil core
34 Second coil
36 Flange section
38 Device component
40 End face
42 Scope
44 Shielding
46 Central shielding section
48 Outer shielding section
50 Printed circuit board
52 First winding layer
54 Second winding layer
56 Conductor path
58 Through connection
60 Substrate
62 Lacquer layer
64 Third coil
66 Third winding layer
68 Fourth winding layer
α Angle
A Exterior
I Inner area
L Longitudinal direction
m Magnetic dipole moment
N Normals to the outer antenna sections
Q Transverse direction
S Coil axis

The invention claimed is:

1. An antenna for inductive information and/or energy transmission, the antenna comprising:

an antenna base body being a foil having a central coil core section and outer antenna sections opposite one another on two sides of said central coil core section;

a first coil disposed on said central coil core section;

each of said outer antenna sections having an edge-side coil core section adjoining said central coil core section and holding a second coil; and said outer antenna sections being disposed at an angle relative to said central coil core section;

wherein the antenna is configured as a hearing aid antenna.

2. The antenna according to claim 1, wherein each of said outer antenna sections has a flange section, which adjoins an end face of said edge-side coil core section remote from said central coil core section.

3. The antenna according to claim 2, wherein said flange section has a shape of a circular arc.

4. The antenna according to claim 1, further comprising foil-shaped shielding arranged respectively on a side of said two outer antenna sections facing said central coil core section and on a side of said central coil core section facing towards said outer antenna sections.

5. The antenna according to claim 4, wherein said shielding is larger than or equal to said antenna base body and covers said antenna base body.

6. The antenna according to claim 4, wherein:

said shielding and said antenna base body are integrated into a flexible printed circuit board, a first winding layer and a second winding layer are arranged on opposite broad sides of said antenna base body; and each of said first winding layer and said second winding layer has conductor paths by way of which the windings of said first coil and said second coil are formed.

7. The antenna according to claim 6, further comprising a third winding layer and a fourth winding layer arranged on a broad side of said first winding layer facing away from said antenna base body, or on a broad side of said second winding layer facing away from said antenna base body, with a third coil being formed by way of conductor paths of said third winding layer and by way of conductor paths of said fourth winding layer and being arranged concentrically with respect to said first coil or one of said second coils.

8. The antenna according to claim 1, wherein:

said antenna base body is integrated in a printed circuit board, a first winding layer and a second winding layer are arranged on opposite broad sides of said antenna base body; and each of said first winding layer and said second winding layer has conductor paths by way of which the windings of said first coil and said second coil are formed.

9. A method, comprising:

providing an antenna according to claim 1;

operating the antenna for generating a magnetic dipole moment and setting a spatial orientation of the magnetic dipole moment by selectively activating one of the second coils, both second coils, and/or the first coil, according to an orientation of a receiver relative to the antenna.

10. The method according to claim 9, wherein the activating step comprises selectively energizing the coils in dependence on the orientation of the receiver relative to the antenna.

11. A device, comprising an antenna according to claim 1.

12. The device according to claim 11 configured as a hearing device with the antenna.

13. The device according to claim 12, wherein the hearing device is a hearing aid.

14. The device according to claim 11, further comprising a device component at least partially surrounded by said antenna.

15. The device according to claim 14, wherein said device component is an energy storage device.

16. The device according to claim 14, wherein:

the outer antenna sections are arranged on mutually opposite end faces of said device component; and the central coil core section overlaps a peripheral area of said device component.

17. An antenna for inductive information and/or energy transmission, the antenna comprising:

an antenna base body being a foil having a central coil core section and outer antenna sections opposite one another on two sides of said central coil core section;

a first coil disposed on said central coil core section;

each of said outer antenna sections having an edge-side coil core section adjoining said central coil core section and holding a second coil; and said outer antenna sections being disposed at an angle relative to said central coil core section;

a foil-shaped shielding arranged respectively on a side of said two outer antenna sections facing said central coil core section and on a side of said central coil core section facing towards said outer antenna sections.

18. A method, comprising:

providing an antenna according to claim 17;

operating the antenna for generating a magnetic dipole moment and setting a spatial orientation of the magnetic dipole moment by selectively activating one of the second coils, both second coils, and/or the first coil, according to an orientation of a receiver relative to the antenna.

19. A device, comprising an antenna according to claim 17.

20. The antenna according to claim 17, wherein each of said outer antenna sections has a flange section, which adjoins an end face of said edge-side coil core section remote from said central coil core section.

* * * * *